US005938565A

United States Patent [19]

Bernacki

[11] Patent Number: 5,938,565

[45] Date of Patent: Aug. 17, 1999

[54] SWIM TRAINING DEVICE

[76] Inventor: Robert H. Bernacki, P.O. Box 3188, Bloomington, Ind. 47402

[21] Appl. No.: 09/110,053

[22] Filed: Jul. 3, 1998

Related U.S. Application Data

[63] Continuation-in-part of application No. 08/708,644, Sep. 5, 1996, Pat. No. 5,813,945.

[51] Int. Cl.[6] ..... A63B 69/12

[52] U.S. Cl. ..... 482/5; 482/6; 482/55; 434/247

[58] Field of Search ..... 482/1–9, 55, 901, 482/903; 434/247, 254, 255

[56] References Cited

U.S. PATENT DOCUMENTS

| | | | |
|---|---|---|---|
| 4,114,874 | 9/1978 | Mattilla . | |
| 5,391,080 | 2/1995 | Bernacki et al. | 482/6 |

FOREIGN PATENT DOCUMENTS

| | | |
|---|---|---|
| 2596663 | 10/1987 | France . |
| 237325 | 5/1994 | New Zealand . |
| 874080 | 10/1981 | U.S.S.R. . |
| 1192840 | 11/1985 | U.S.S.R. . |
| 1535554 | 1/1990 | U.S.S.R. . |

*Primary Examiner*—Glenn E. Richman

[57] ABSTRACT

An instructional, training, and assessment apparatus is provided for use in the activity of swimming. The apparatus includes a cable having a proximal end and a distal end, and a harness for coupling the distal end of the cable to a swimmer. The distal end of the cable is formed to include a short length of increased diameter. A motorized drum mechanism is coupled to the proximal end of the cable for winding and unwinding the cable to apply forces to the swimmer as the swimmer swims laps in a body of water. A pressure roller applies pressure to the cable as it is wound and unwound in single layer upon the drum. A bailer sheave and idler roller engaged with the sheave and mounted on shafts transverse to the drum guide the cable loops in even rows onto the drum. A cable diameter limit sensor coupled to the bailer sheave and the motorized drum senses the increased diameter of the distal end of the cable and produces a corresponding output signal. Cable speed and force sensors are provided for generating output signals responsive to the speed of and force exerted on the cable. The apparatus also includes a controller responsive to the output signal from the force sensor and the speed sensor and to an external speed parameter represented by a reference signal for controlling the forces applied by the winding and unwinding mechanism to the swimmer while the swimmer is swimming in a body of water. The controller additionally receives the output signal from the cable diameter sensor and when the output signal becomes true, the controller halts the winding action of the motorized drum thereby halting the cable.

3 Claims, 7 Drawing Sheets

SWIM TRAINING DEVICE

RELATED APPLICATIONS

The above identified application is a continuation-in-part of prior application Ser. No. 08/708,644, filed Sep. 5th, 1996, the entire contents of which are incorporated herein by reference.

FIELD OF THE INVENTION

The present invention relates to swim training devices and, in particular, to towing or speed assist devices which apply forces to a swimmer through a cable which is coupled to a motorized drum.

BACKGROUND OF THE INVENTION

One of the key concepts of athletic training is specificity of training. The training activity most appropriate to achieving optimal swimming performance is that of swimming at competition or maximal speeds. Since that level of performance can only be maintained for very short periods of time, external assistance is required for extended training periods.

Recently, a sophisticated apparatus for swim instruction, training, and assessment permitted the implementation of this coaching principle in practice (see my U.S. Pat. No. 5,391,080).

SUMMARY OF THE INVENTION

In the present invention, an improved apparatus is revealed for the application of forces to a swimmer while swimming for the implementation of various instructional, training, and assessment methodologies. Improvements are obtained through a reduction in the complexity of mechanics while providing for more accurate cable winding.

In accordance with the present invention, means are revealed for applying positive and negative forces to a swimmer while swimming in a body of water through a cable attached to the swimmer and to a motorized drum. Further, the motorized drum incorporates features which provide for even winding and unwinding of the cable upon the drum. In addition, the motorized drum incorporates an motor and a full limit sensor for sensing a change in the diameter of the cable, such diameter change occurring near a distal end of the cable which is proximal to the swimmer, the sensor, upon sensing the change in the diameter of the cable, signals the motorized drum motor which in turn responds by altering the winding or unwinding operation of the drum.

The contemplated embodiment of the present invention is comprised of mechanical means which includes a harness coupled to cable means, which passes through a bailer sheave, coupled to a cable diameter sensor and a drum pressure roller, and further coupled to a cable drum. Said cable drum is coupled to and rotates a worm screw shaft which is also coupled to the bailer sheave, the bailer sheave being mounted concentrically upon the screw shaft, whereby the rotation of the drum causes the screw shaft to move the bailer sheave transversely to the drum forming evenly spaced winds of cable upon the drum. Said cable drum is further coupled to an electric motor which in turn is coupled to a power controller. Said power controller includes a battery power source, coupled to a power regulator which is coupled to a power relay, coupled to a run button and coupled to a programmable logic and numeric processing means.

Additional objects, features, and advantages of the present invention will become apparent to those skilled in the art upon consideration of the following illustration of the contemplated embodiment presented in the detailed description and accompanying drawings.

BRIEF DESCRIPTION OF THE DRAWINGS

The detailed description of the contemplated embodiment makes reference to the accompanying figures in which.

DETAILED DESCRIPTION OF THE PRESENT INVENTION

Referring now more particularly to the figures, enumerated as numbers 1 through 6, the following detailed description of mechanical drawings, block diagrams, and schematics, shall serve to illuminate various particulars of an illustrative embodiment of the disclosures and teachings of the present invention. Throughout the following description are several references to specific mechanical and electrical components which serve to clarify various aspects of the invention. It will be understood that these specific component references are not limitations and that the teachings and disclosures of the present invention may be practiced with alternative components. In other instances, structures and methods well known to those skilled in the art or which have been revealed in detail in my previous U.S. Pat. No. 5,391,080 have been omitted or have not been described in detail in order to avoid unnecessary complexity which would tend to obscure the teachings and disclosures of the present invention. In particular, programs, flowcharts, and machine code are not presented herein as the relevant information has been revealed in extensive control flowcharts taught in my above mentioned patent.

Figure 1:
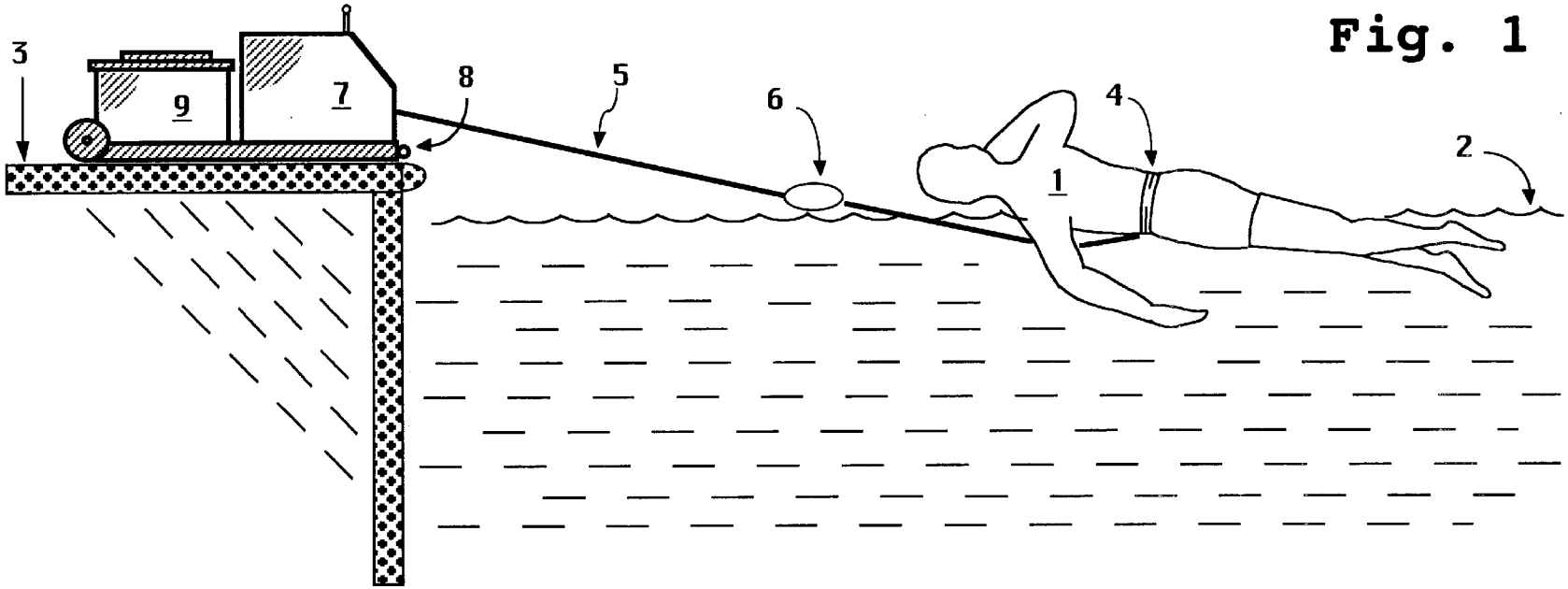
FIG. 1 depicts the apparatus mounted at poolside and attached to a swimmer via a line and harness assembly.

Referring now to FIG. 1, a swimmer herein referred to by the numeral 1 is depicted in a body of water 2 and is attached at the waist via a belt of other harness 4 to a plastic coated stainless steel aircraft cable 5. A float 6 is attached to the cable 5 just before the swimmer 1. Subsequently, the cable 5 is directed upwards from the water surface 2 to a drive train assembly 7 mounted with a battery housing 9 on a base 8 which is depicted resting on a pool deck 3.

Figure 2:
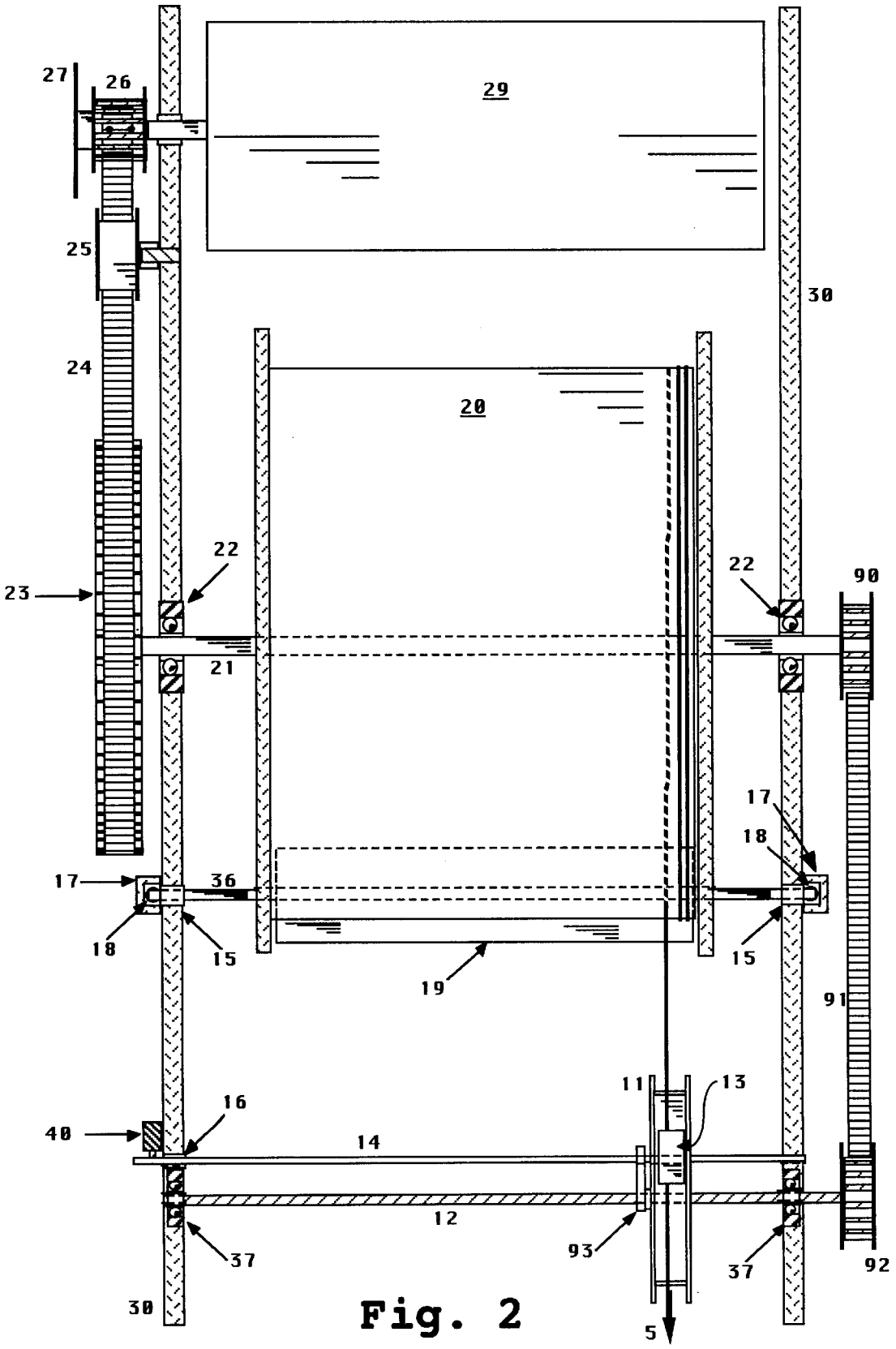
FIG. 2 depicts the top view of one embodiment of the present invention illustrating several of the principle features of the mechanical drive train including the drum, the bailer, the motor, and the drive train.

Referring now to FIG. 2, the cable 5 is guided by a bailer sheave 11 mounted on a stainless steel screw shaft 12 and an idler roller 13 mounted on a stainless steel shaft 14, the cable 5 being directed towards the top of a pressure roller 19 and subsequently onto a flanged drum 20 mounted on a stainless steel shaft 21. The drum shaft 21 rotates in a pair of drum bearings 22 which are mounted in a frame assembly 30 of the drive train 7. The pressure roller 19 is mounted on a stainless steel shaft 36 which passes through slots 15 in the frame 30. The frame 30, drum 20, pressure roller 19, idler roller 13 and sheave 11 should be fabricated from PVC, DELRIN, Teflon, or other similar corrosion resistant materials. The stainless steel shafts should all be equivalent to or exceed grade 316 ratings. The idler roller shaft 14 is mounted on the right to the frame 30 and on the left passes through a slot 16 in the frame assembly 30 and subsequently contacts a limit switch 40. The limit switch 40 should have a rating equal to, or exceeding IP67 or NEMA 4X. A pair of compression springs 18 located in a pair of spring guides 17 fastened to the frame 30 apply an upward force on the pressure roller shaft 36 which in turn forces the pressure roller 19 to press the cable 5 against the drum 20. The left end of the drum shaft 21 is coupled to a timing pulley gear 23 which in turn is coupled to a timing pinion 26 via a timing belt 24 which is tensioned by an idler pulley 25. The timing pinion 26 is coupled to a motor 29 and to an optical rotational encoder disk 27. Although an electric motor 29 is shown as a motive power source, alternative motive power sources, such as hydraulic or pneumatic motors, may be employed. The sheave screw shaft 12 passes through a pair of bearings 37 mounted in the frame assembly 30. Coupled to the sheave 11 is a lever arm 93 which rides on the idler roller shaft 12. Mounted on the right end of the screw shaft 12 is a timing gear 92 which in turn is coupled via a timing belt 91 to a timing pinion 90 mounted on the right end of the drum shaft 21. All bearings races should be of a stainless steel or plastic construction and the bearing balls should be fabricated of stainless steel or glass and should have covers or seals enclosing them.

Figure 3:
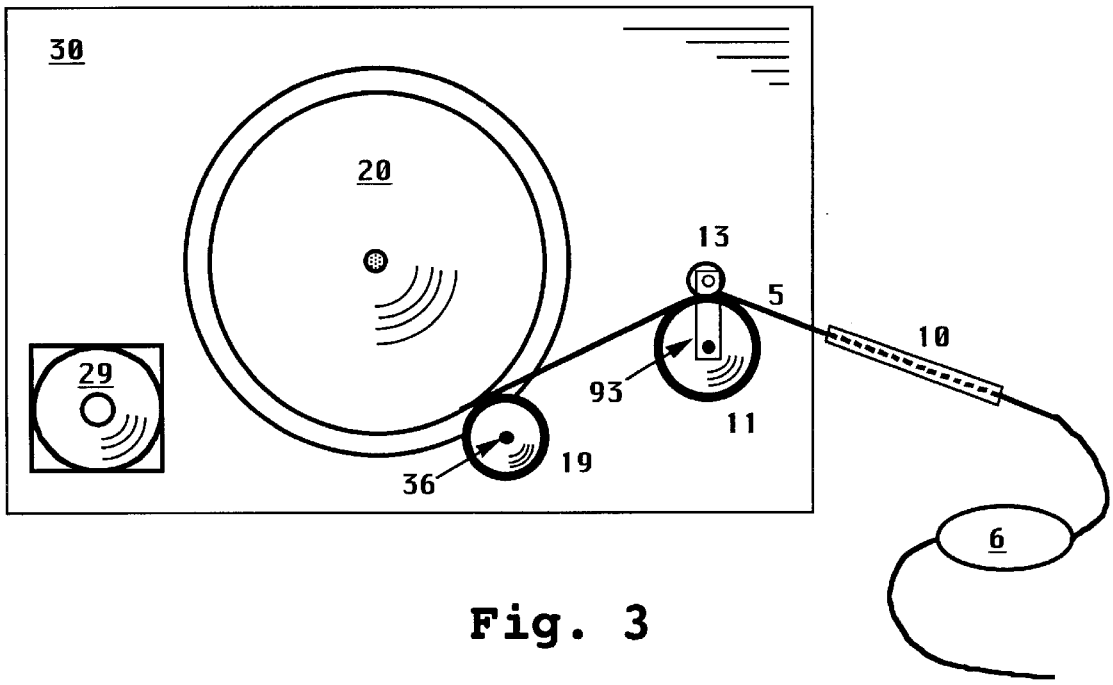
FIG. 3 is a cross-section view of the internal components of the mechanical drive train depicted in FIG. 2.

Referring now to FIG. 3, which depicts a cross-section view of the internal components of the mechanical drive train of FIG. 2, the drum 20 contacts the pressure roller 19 which is mounted on the roller shaft 36. The cable 5 is guided away from the drum 20 by the pressure roller 19 towards the bailer sheave 11 upon which rides the idler roller 13 which causes the cable 5 to remain in contact with the bailer sheave 11. The cable 5 passes through a plastic jacket 10, is then coupled to the float 6 and subsequently to the harness 4 at the swimmer's 1 waist. Coupled to the sheave 11 is the lever arm 93 which is located adjacent to the idler roller 13.

Figure 4:
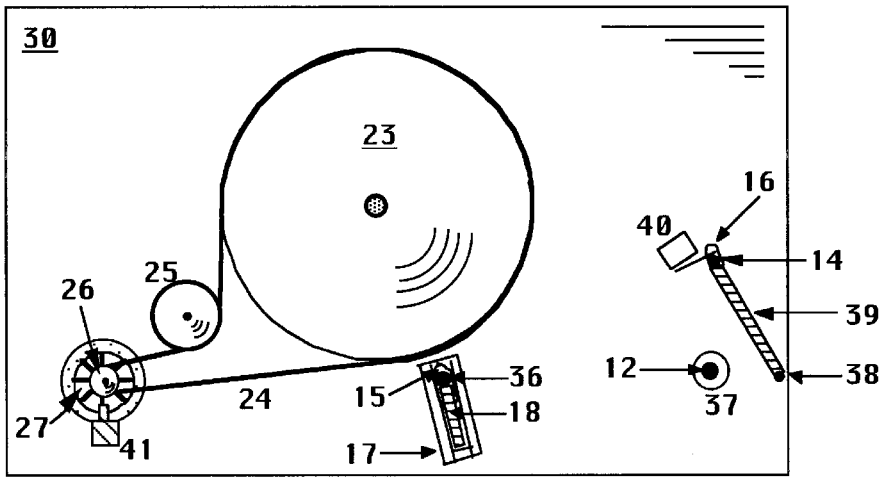
FIG. 4 is a side view of the external components of the mechanical drive train depicted in FIG. 2.

Referring now to FIG. 4, which depicts a side view of the external components of the mechanical drive train depicted in FIG. 2, the timing pulley gear 23 is coupled to the timing pinion 26 via the timing belt 24 which is tensioned by the idler pulley 25 which in turn is mounted to the frame assembly 30. The timing pinion 26 is also coupled to the optical rotational encoder disk 27 which is optically coupled to the optical encoder sensor 41. The pressure roller shaft 36 which passes through the slot 15 in the frame 30 and contacts the top of the compression spring 18 located in the spring guide 17 fastened to the frame 30. The idler roller shaft 14 passes through the slot 16 in the frame assembly 30 and subsequently contacts the limit switch 40. The idler roller shaft 14 receives a positive force away from the limit switch 40 from a tension spring 39 whose upper end is coupled to the idler roller shaft 14 and whose lower end is coupled to the frame assembly 30 with a pin 38. Below the idler roller shaft hole 16 is the end of the bailer sheave shaft 12 which passes through the bearing 37.

Figure 5:
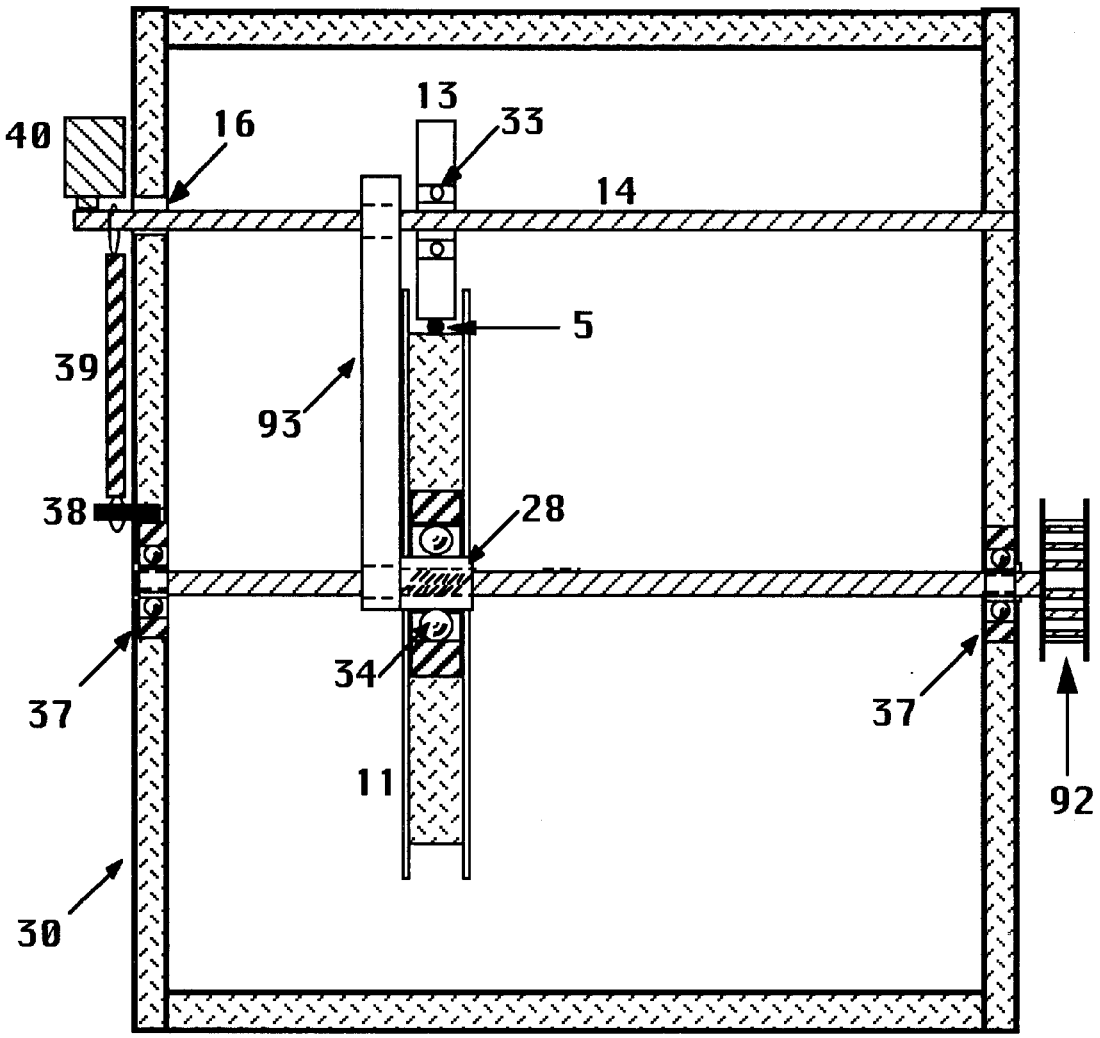
FIG. 5 is a front view of the mechanical drive train depicted in FIG. 2 illustrating the cable, full limit sensor, bailer sheave, and screw shaft.

Referring now to FIG. 5, which depicts a front view of the mechanical drive train depicted in FIG. 2. The idler roller shaft 14 is mounted on the right frame assembly 30 and passes through the slot 16 in the left side of the frame assembly 30 to subsequently contact the limit switch 40. The idler roller shaft 14 receives a positive force away from the limit switch 40 from the tension spring 39 whose upper end is coupled to the idler roller shaft 14 and whose lower end is coupled to the frame assembly 30 with the pin 38. The sheave screw shaft 12 passes through the pair of bearings 37 mounted in the frame assembly 30. Mounted on the right end of the screw shaft 12 is the timing gear 92. The cable 5 is confined between the bailer sheave 11 and the idler roller 13. The idler roller 13 rotates about the idler roller shaft 14 on ball bearing set 33 which is fitted loosely on idler roller shaft 14. The bailer sheave 11 rotates about the bailer sheave shaft 12 on ball bearing set 34 which is pressed onto an acme screw nut 28 which is threaded over the bailer sheave shaft 2. Mounted on the sheave acme screw nut is the lever arm 93 which also rides loosely on the idler roller shaft 12.

Figure 6:
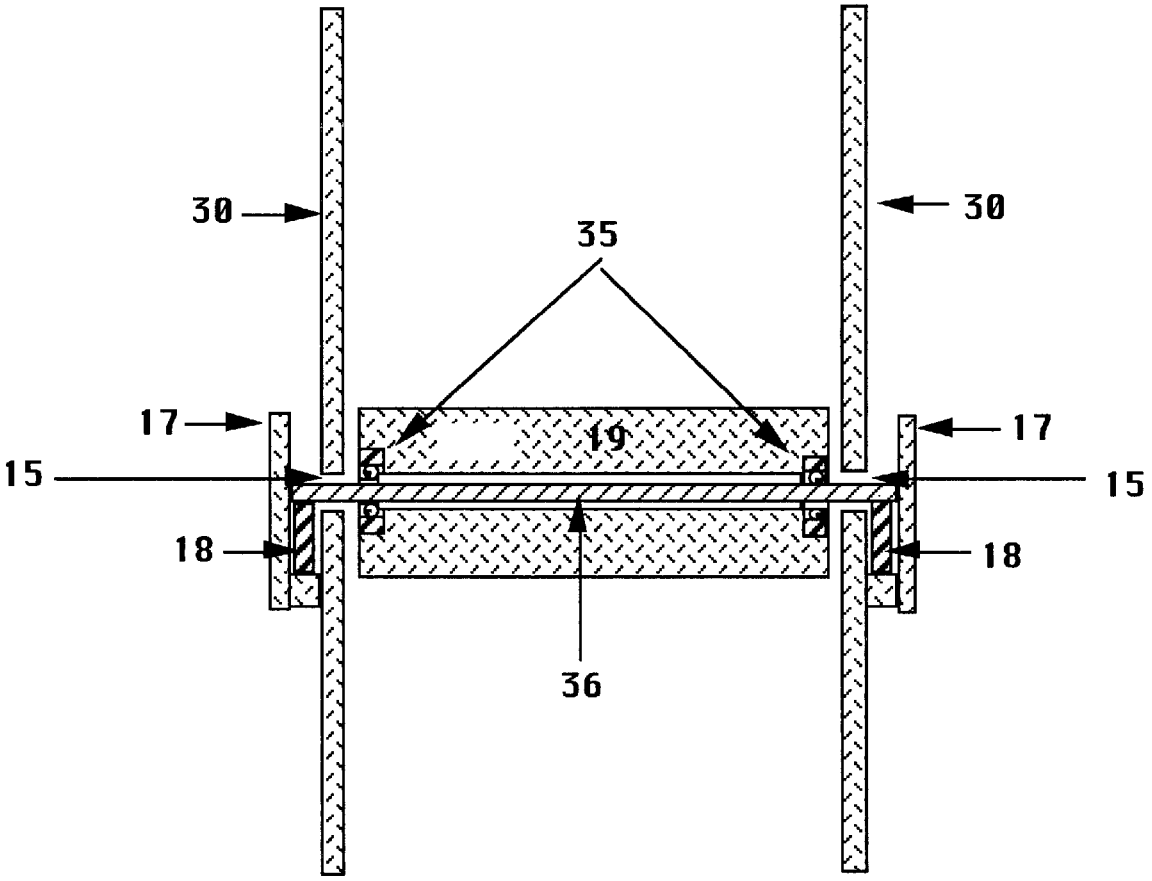
FIG. 6 is a detailed front view of the drum roller.

Referring now to FIG. 6 which depicts a detailed front view of the pressure roller, the pressure roller 19 has a ball bearings 35 which are pressure fitted into the pressure roller 19 and onto the roller shaft 36. The pressure roller shaft 36 passes through slots 15 in the frame 30 and extends into the spring guides 17 fastened to the frame 30. The pressure roller shaft 36 contacts the pair of compression springs 18 located in the pair of spring guides 17 and receives an upward force from the pair of compression springs 18.

Figure 7:
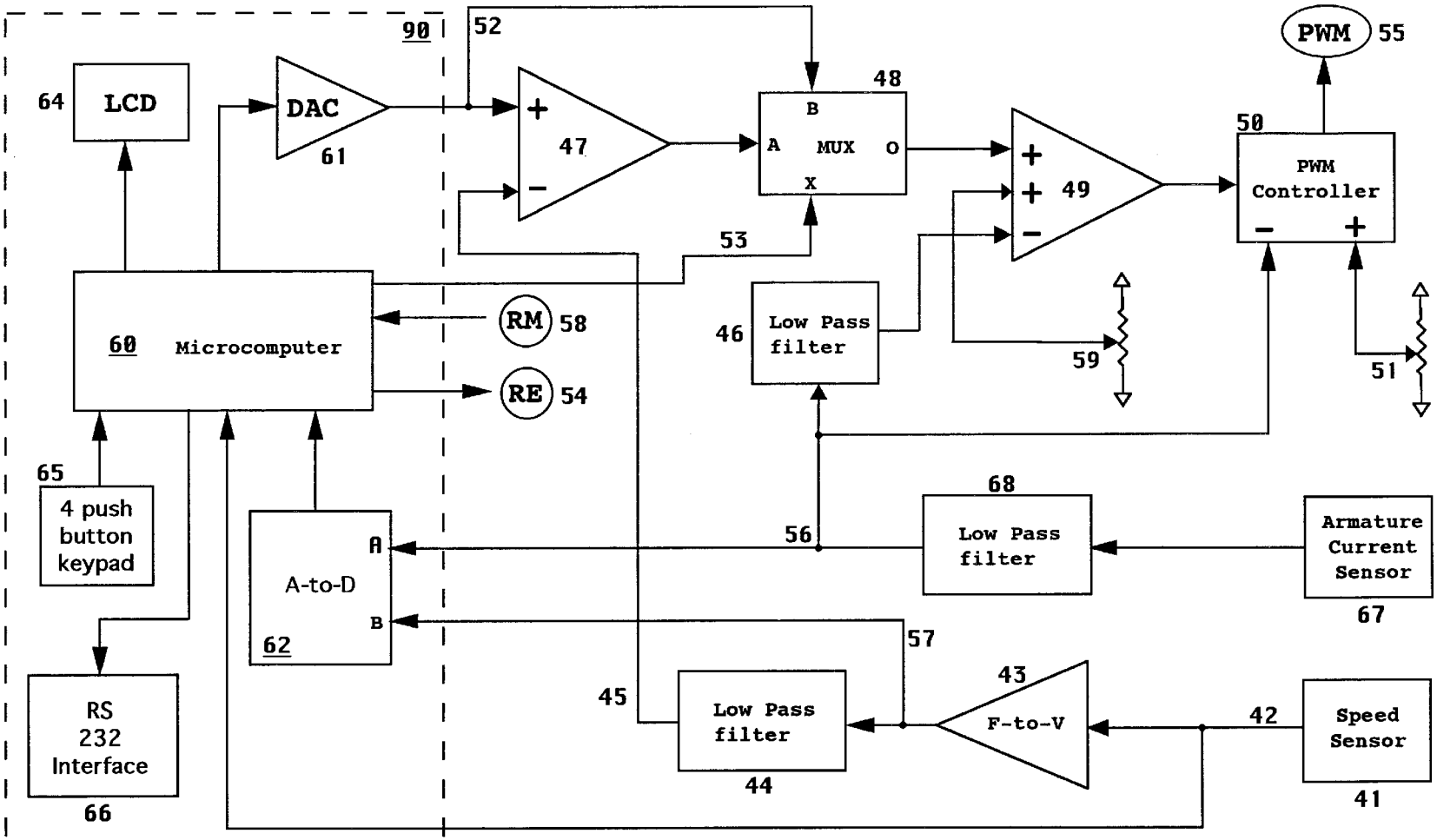
FIG. 7 is a block diagram summary of the electronic control system.

FIG. 7 depicts a block diagram illustration of an electronic control system which provides for the implementation of the various control functions as described below. Controller 90 is comprised of a single IC microcomputer 60, such as the Motorola 68HC11 series, which is coupled to an Liquid Crystal display (LCD) module 64 having 2 lines of 16 characters, a four button keypad 65, the input of a Digital to Analog (DAC) converter 61, the output of a multiplexed Analog to Digital converter (A2D) 62, and to the input of an RS-232 serial interface 66. A typical DAC for this application would be the MAXIM MAX530 device and the serial interface would be the MAXIM MAX201 device. A typical LCD for this application would be the OPTREX DMC16202NY-LY which includes an LED backlit feature. Various other combinations of microprocessors and support components from other manufacturers might also be utilized, as would be evident to one skilled in the art. The particular choice of processors would depend upon the complexity of the various protocols and measurements one wished to implement on the present invention and their related speed and processing requirements.

The output 52 of the DAC 61 is coupled to a summation input of a first differencing amplifier 47 and to an analog multiplexer 48 B input whose A input is coupled to the output of the first differencing amplifier 47 and whose X control input is coupled to a digital output 53 of the microcomputer 60. The output of the analog multiplexer 48 is coupled to a summation input of a second differencing amplifier 49 whose output is coupled to a Pulse Width Modulation (PWM) controller 50 such as the Texas Instrument TL594 integrated circuit. The PWM output 55 of the PWM controller 50 is coupled to the power control circuit of FIG. 8. An analog offset from resistor divider 59 is summed into the force difference amplifier 49. The microcomputer 60 additionally has an output RE 54 coupled to the power control circuit of FIG. 8 and an input RM 58 coupled to the power control circuit of FIG. 8.

A digital output 42 of the optical encoder sensor 41 is coupled to the microcomputer 60 and to the input of a frequency-to-voltage (F2V) converter 43 such as the National LM2917. The output signal 57 of F2V converter 43 is coupled to the input of a speed signal lowpass filter 44 and to a B input of the A2D converter 62. The output 45 of the speed signal lowpass filter 44 is coupled to an inverting input of the first differencing amplifier 47. An analog output of a motor armature current sensor 67, such as the F. W. Bell BB-100 unit, is coupled to the input of a first current signal lowpass filter 68 whose output 56 is coupled to an A input of the A2D converter 62, to the input of a second current signal lowpass filter 46, and to the inverting input of the PWM controller 50. The output of the second current signal lowpass filter 46 is coupled to the inverting input of the second differencing amplifier 49. A reference signal set by a variable resistor 51 is coupled to the non-inverting input of the PWM controller 50.

Although the illustration of the programmable controller 90 of FIG. 7 employs a microcomputer to implement the various functions of the present invention, there are other various logic implementation such as programmable gate arrays, microprocessors available to one skilled in the art which might be employed to carry out the tasks required. Another embodiment of the present invention might substitute a variable calibrated voltage source for the programmed DAC 61 output 52 combined with coupling control signal RM 58 to control signal 53 and the establishment of a fixed logic level true for signal RE 54.

Figure 8:
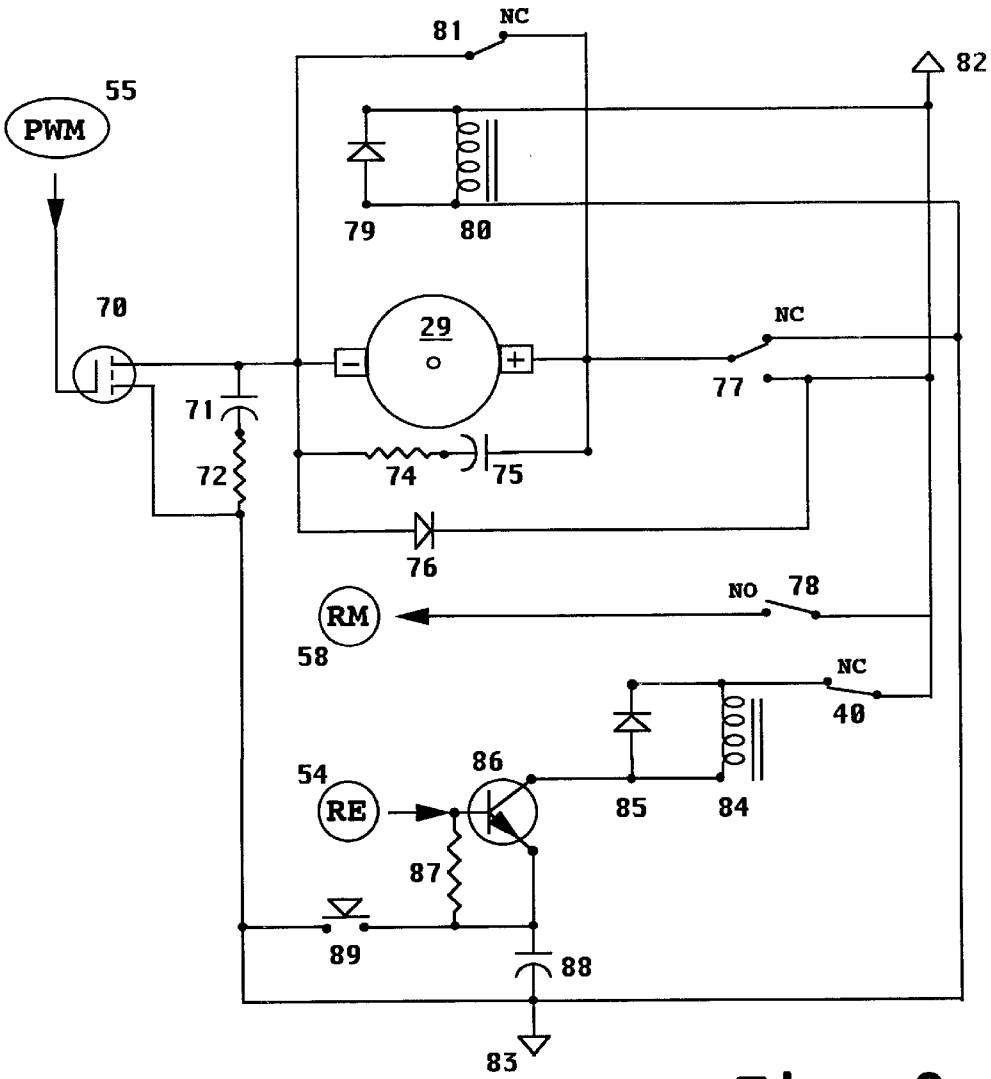
FIG. 8 is a electronic schematic diagram of the motor circuit.

Reference is now to made to the schematic of power control circuit depicted in FIG. 8. An FET transistor 70 whose source is coupled to a battery ground 83, whose gate is controlled by the PWM signal 55. The drain of the FET transistor 70, such as the MOTOROLA MTB75N05HD HDTMOS power MOSFET, is coupled coupled to a negative terminal of an electric motor 29 and to a snubber capacitor 71 which in turn is coupled to a snubbing resistor 72 which then is coupled to battery ground 83. The electric motor is preferably of the permanent magnet type with skewed armature poles. A positive terminal of the electric motor 29 is coupled through the current sensor 67 and references to the positive terminal shall be assumed to pass through the sensor 67. The negative terminal of the electric motor 29 is coupled to a snubbing resistor 74 which is coupled to a snubber capacitor 75 which is coupled to a positive terminal of the electric motor 29. The negative terminal of the electric motor 29 is also coupled through a normally closed contact set 81 of a relay 80 to the positive terminal of the electric motor 29. A first coil terminal of the relay 80 is coupled to a battery positive 82 and to a cathode of a diode 79, the anode of which is coupled to battery ground 83 and to a second coil terminal of the relay 80. The negative terminal of the electric motor 29 is also coupled to an anode of a diode 76 whose cathode is coupled to battery positive 82. The positive terminal of the electric motor 29 is also coupled to a relay 84 first SPDT contact set 77 common whose normally closed contact is coupled to battery ground 83 and whose normally open contact is coupled to battery positive 82. The signal RM 58 to the controller 90 of FIG. 7 is coupled to a second SPDT contact set 78 common of the relay 84 whose normally open contact is coupled to battery positive 82.

A first terminal of the coil of relay 84 is coupled through a normally closed contact set of the limit switch 40 to battery positive 82. A second terminal of the coil of relay 84 is coupled to a transistor switch 86, such as type 2N2222, collector terminal. The transistor switch 86 emitter terminal is coupled through the normally open contacts of a operator run switch 89 to battery ground 83. The digital control output signal RE 54 from the controller 90 of FIG. 7 connects to the base of transistor switch 86. The base and emitter of the transistor switch 86 are shunted by a resistor 87 and the contacts of the run switch 89 are shunted by a bypass capacitor 88.

Description of the Operation of the Invention

The following review of the general operation of the present invention is merely for illustrative purposes, and should in no way be considered either the sole or limiting view of the breadth and range of possible operational characteristics.

Preparations for the operation of the present invention consist of positioning the base 8 of the device adjacent to the edge of a pool deck 3 as shown in FIG. 1, instructing the swimmer 1 to strap the harness assembly 4 around his waist and to enter the water 2. The default protocols for purposes of this illustration consist of a training resistance outgoing lap, and an assisted return lap. Operation begins with a message on the LCD 64 requesting the operator to select pool size, to set a resistance force, and then an assist speed. The operator selects these parameters by pushing the respective buttons on the keypad 65 increasing or decreasing the parameters as desired. The operator then indicates to the swimmer that the lap may begin. When the swimmer is ready, he swims out in the resistance mode which is the default state of the mode relay 84. The operator does not press the run button 89 thereby leaving it in the normally open state which prevents the transistor 86 from actuating the mode relay 84 and therefore the contact set 77 remains in the normally closed state. The relay control transistor 86 has the base resistor 87 coupled to it's emitter for turn-off stability and the emitter bypass capacitor 88 suppresses contact bounce of the run switch 89. The braking relay 80 contacts 81 short the motor 29 terminals whenever power is removed from the device and so results in the braking of the motor 29.

As the swimmer begins swimming a resisted, negative force, outgoing lap, the cable 5 takes up tension, the float 6 assists in maintaining the cable above the swimmer's legs and the cable jacket 10 exits the drive train. The cable jacket 10 travels down from under the idler roller 13, around the sheave 11, rotating the sheave about the sheave bearing 34, moves away from the drum 20 traveling over the pressure roller 19 and off of the cable drum 20 causing the drum 20 to rotate. When the end of the cable jacket 10 passes the idler roller 13, the idler roller shaft 14 disengages the limit switch 40 due to a positive force from the tension spring 39 and permits the limit switch 40 contacts to return to the normally closed position. The pressure roller 19 rotates on bearings 35 mounted on shaft 36 and is forced towards the drum 20 by the pressure roller springs 18. As the cable 5 is unwound from the drum 20, the bailer sheave 11 travels on the acme nut 28 which is moving in lead screw fashion on the screw shaft 12 to follow the lateral motion of the cable 5 on the drum 20. The screw shaft is rotated by the timing gear 92 which is coupled to the timing pinion gear 90 via the timing belt 91. the acme nut 28 is restricted from a full rotation by the lever arm 93 thereby causing the acme nut 28 to travel transversely on the screw shaft.

The rotating drum 20 engages the drum shaft 21 which rotates in the drum bearings 22 mounted in the drive train frame 30 and subsequently rotates the timing gear 23. The timing gear in turn engages the timing belt 24 which passes under the belt idler 25 and engages the timing pinion 26 which couples rotational power to the motor 29. The optical sensor disk 27 rotates with the pinion 26 and causes a speed signal 42 to be output by the speed sensor 41.

The motor 29 subsequently generates a voltage which in turn causes a current to flow from the battery ground 83 through the power FET 70 into the negative terminal of the motor 29 and from the positive terminal of the motor 29 through the current sensor 67, through the normally closed contacts of contact set 78 to the battery ground 83. Flyback diodes 76, 79, and 85 serve to return reverse inductive currents and thereby prevent excessive buildups of reverse inductive voltages when currents through their respective inductors are interrupted. Suppression resistor and capacitor series pairs 71, 72 and 74,75 reduce unwanted RF energy generation. The current through the power FET 70 is regulated by the PWM signal 55. The current sensor 67 signal represents the motor 29 armature current which is directly proportional to the torque of the motor 29. Therefore, the current signal may be considered an equivalent to a force signal for purposes of discussion. The control of the motor is therefore characterized as a current control method. The PWM signal 55 is proportional to a function of the user selected control parameter of resistance force, which is applied to the non-inverting input of the force difference amplifier 49 and the force signal from the output of the second force filter 46, which is applied to the inverting input of the force difference amplifier 49, the output of which controls the degree of modulation generated by the PWM controller 50 in the manner of a force negative feedback loop. The force level set in the controller 90 microcomputer 60 is output to the DAC 61 which converts the digital signal to an analog signal voltage at the DAC output 52 which is directed through the multiplexer 48 to the non-inverting input of the difference amplifier 49. The multiplexer 48 selection path is controlled by digital control signal 53 from the microcomputer 60.

When the swimmer 1 reaches the end of the resisted lap out, turns around, and makes ready, he signals the operator. As described above at the start of the lap out, the limit switch rod 14 disengages the limit switch 40 returning the contacts to the normally closed position which in turn completes one leg of the circuit of the mode relay 84. After the operator finishes setting the parameters, the microcomputer 60 outputs a logical high on the RE 54 signal line to enable the mode relay transistor 86. To initiate the assisted return lap in, the operator presses the run button 89 to complete the current path to the mode relay 84 which then closes the normally open contacts of contact set 77 to connect the positive terminal of the motor 29 to the battery positive 82. The above described mechanical operation of the outward lap is now reversed wherein the motor 29 provides a torque which rotates the drum 20 in a direction opposite to that of the outward lap and thereby winds the cable around it, applying force to the cable 5. The cable 5 in turn applies this force to the swimmer 1 which results in a reduction in the force required of the swimmer's 1 own propulsion. As the cable 5 winds in onto the drum 20, the pressure roller 19 works to maintain the cable 5 in an even wind while the bailer sheave 11 travels in a lateral motion which results in an even wind of cable upon the drum 20. At anytime, the operator may release the run button 89 to immediately shut off the motor 29 by removing the current from the coil of the mode relay 84. When the cable is wound in completely, the cable jacket 10 passes under the idler roller 13 forcing the idler roller shaft 14 to overcome the force of tension spring 39 and to engage the limit switch 40 whose contacts are forced into the normally open position thereby interrupting the current flow through the coil of mode relay 84.

During the return assisted lap, wherein a positive or towing force is applied to the swimmer, control of the motor 29 speed and therefore the cable and swimmer's speed is accomplished by means of a speed feedback loop. The motor 29 current through the power FET 70 is regulated by the PWM signal 55. The PWM signal 55 is proportional to a function of the user selected control parameter of speed and the speed signal output 45 of the speed low pass filter 44. The motor 29 speed is converted to a digital pulse signal output 42 by the optical encoder sensor 41 which is converted by the frequency-to-voltage converter 43 to an analog signal. The output of the converter 43 is coupled to the input of the speed signal lowpass filter 44 and to the B input of the A2D converter 62 for monitoring by the microcomputer 60. The output 45 of the speed signal lowpass filter 44 is coupled to the inverting input of the speed differencing amplifier 47. The speed parameter set in the microcomputer 60 is output to the DAC 61 which converts the digital signal to an analog signal voltage at the DAC output 52 which is coupled to the non-inverting input of the speed difference amplifier 47. The output of the speed differencing amplifier 47 is directed through the multiplexer 48 from the A input to the non-inverting input of the difference amplifier 49. The multiplexer 48 selection path is controlled by digital control signal 53 from the microcomputer 60. The speed difference signal at the output of the speed differencing amplifier 47 therefore represents the difference between the desired speed and the actual speed. The gain of the speed differencing amplifier 47 is a scale factor that converts the speed difference signal into an optimal force signal that is employed as a reference force signal for force difference amplifier 49. As described above, the PWM signal 55 is proportional to the reference force signal applied to the non-inverting input of the force difference amplifier 49 and the force signal from the output of the second force filter 46, which is applied to the inverting input of the force difference amplifier 49, the output of which controls the degree of modulation generated by the PWM controller 50 in the manner of a force negative feedback loop. Whenever the force applied by the motor 29 exceeds a preset maximum value during the inbound lap, the force is limited by a threshold comparator in the PWM controller 50. The force signal lowpass filter 68 output 56 is coupled to the inverting threshold input of the PWM controller 50 and a reference signal set by the variable resistor 51 is coupled to the non-inverting input of the PWM controller 50. Whenever the force signal 56 exceeds the reference voltage at resistor 51, the PWM controller 50 is restricted to that force and cannot exceed it. The device must also compensate for mechanical losses in the drive train which is accomplished with an analog offset from resistor divider 59 for summation into the force difference amplifier 49. Other compensation methods might include modifying the force parameters which are set in the microcomputer 60 to include offsets for such compensation.

The characteristics of the speed low pass filter 44 are typically those of a lowpass filter which filters out the variations in speed within the stroke, or stroke ripple, to provide a smoothed or averaged speed feedback signal. The short-term averaging interval of the speed filter should range from one half of a stroke in duration to twice a stroke duration. The characteristics of the force low pass filter 46 are typically those of a lowpass filter which filters out the variations in speed that are much faster than the stroke ripple frequency, such as those attributable to mechanical drive train sources, while passing variations at or below the stroke ripple frequency. The short-term averaging interval of the force filter should range from less than one half of a stroke in duration to approximately one twentieth of a stroke duration. The assistance force applied to the swimmer assists him in overcoming the force of drag thereby increasing his speed over the maximum he might attain otherwise. The speed control paces the swimmer at an averaged assist velocity which aids in the training of the swimmer's stroke rate at competition levels. This speed control system can be considered as a speed feedback system controlling a force feedback system such that a desired speed results in the average force necessary to maintain that speed.

The digital pulse signal 42 from the optical speed sensor is coupled to the microcomputer 60 where it is counted in a pulse accumulator. The count value is directly proportional to the number of rotations of the drive train and therefore to the revolutions of the drum and thus to the quantity of cable 5 wound upon the drum. This provides the microcomputer 60 with information on the location of the swimmer 1 during the lap. The microcomputer 60 additionally has the input RM 58, which signals the state of the mode relay 84, for use in monitoring the status of the device. The force signal 56 from lowpass filter 68 is coupled to the A input of the A2D converter 62 and the speed output signal 57 of the F2V converter 43 is coupled to the B input of the A2D converter 62. This provides the microcomputer 60 with immediate speed and force values for the cable 5. These values may be used in the calculations and control of the motor 29 or may be sent to the serial interface 66 for transmission to a personal computer for storage and plotting. Such a computer might be an industry standard battery powered notebook type IBM PC clone capable of VGA type graphics, a mouse or similar pointing device, and possessing a microprocessor capability of at least an INTEL 486/16 mHz type. A program running on such a computer should permit plotting and measuring of speed and force data as well as a data file storage and retrieval capability.

Applications of the Invention

In the present invention, apparatus and methods are revealed which provide for the measurement and application of positive or negative forces to a swimmer in a pool or aquatic environment while controlling complex relationships of the swimmer's speed, force, power, distance traveled, and elapsed time. The positive force applying means of the present invention provides for the pacing of a swimmer and the off-loading of the propulsive force required of the swimmer at or above competition speeds. This pacing and off-loading encourages improvements in the swimmer's stroke mechanics at elevated speeds for extended periods of time while minimizing detrimental effects on the swimmer's stroke dynamics. The negative force applying means of the present invention provides for the resistive overloading of a swimmer which is believed to increase muscle strength as well as to train the anaerobic energy system. The data transfer and plotting means of the present invention provide for analysis of stroke patterns and rates thereby permitting a coach to provide informed critique and instruction to a swimmer regarding stroke mechanics.

Although one possible embodiment has been described to illustrate the teachings and disclosures of the present invention it is not limited to the specific foregoing illustrative embodiment or applications and that various and several modifications in design, arrangement, and use may be made within the scope and spirit of the invention as expressed in the following claims:

What is claimed is:

1. A swim training device comprising:

a cable having a proximal end and a distal end;

a harness for coupling the distal end of the cable to a swimmer in a body of water;

a motorized drum mounted on a frame and coupled to the proximal end of the cable for winding the cable;

an electrical controller electrically coupled to the motorized drum;

a cable jacket coupled to the cable at the distal end for increasing the thickness of the cable;

a cable sheave mounted on a sheave shaft parallel and proximal to the drum and upon which the cable lays;

a guide roller shaft parallel to the sheave shaft and passing through a guide slot mounted to the frame;

a guide roller, mounted on the guide roller shaft, proximal to and engaging the sheave with the cable traveling between the guide roller and the sheave within a space approximately equal to the cable diameter;

a tension spring with a first end coupled to an end of the guide roller shaft and a second end fixed to the frame; and a limit-switch mounted to the frame proximally to the guide slot, engaging the guide roller shaft and electrically coupled to the electrical controller whereby upon activation of the motorized drum by the electrical controller the cable travels between the guide roller and the sheave and winds onto the drum until the cable jacket reaches the guide roller and sheave forcing the guide roller to move away from the sheave in turn displacing the guide roller shaft which in turn actuates the limit-switch changing the electrical state of the limit-switch whereupon the electric controller responds to the limit-switch change of electrical state by deactivating the motorized drum.

2. The apparatus of claim 1, wherein a spring loaded drum pressure roller for maintaining wound cable against the drum directs the cable onto the drum forming a multiplicity of even rows of the cable.

3. The apparatus of claim 1, wherein the sheave shaft is a screw shaft upon which rides a screw nut which forms the hub of the sheave, the screw shaft being coupled to the motorized drum and rotating in bearings mounted to the frame, the screw nut further being coupled to one end of a lever arm, the other end of which rides on a shaft parallel to the screw shaft, whereby the screw shaft rotates in the sheave screw nut and the lever arm restricts the screw nut from turning thereby moving the nut and sheave transversely in a lead screw fashion subsequently directing the cable onto the drum in even rows.

* * * * *